United States Patent [19]

Mochizuki et al.

[11] 4,138,022

[45] Feb. 6, 1979

[54] FURNACE TOP CHARGING APPARATUS

[75] Inventors: Toshio Mochizuki; Shuji Kajikawa; Keitaro Hirai, all of Fukuyama; Masaaki Yasunaga, Hiroshima, all of Japan

[73] Assignee: Nippon Kokan Kabushiki Kaisha, Tokyo, Japan

[21] Appl. No.: 842,371

[22] Filed: Oct. 14, 1977

[30] Foreign Application Priority Data

Nov. 26, 1976 [JP] Japan ..... 51/141991
Oct. 29, 1976 [JP] Japan ..... 51/146499[U]

[51] Int. Cl.[2] ..... F27B 1/20
[52] U.S. Cl. ..... 214/35 R; 266/176
[58] Field of Search ..... 214/18 R, 35 R, 36, 214/37; 266/176

[56] References Cited

U.S. PATENT DOCUMENTS

| | | | |
|---|---|---|---|
| 3,471,042 | 10/1969 | Gee et al. | 214/35 R |
| 3,929,240 | 12/1975 | Legille et al. | 266/176 X |
| 4,071,166 | 1/1978 | Legille et al. | 214/35 R X |

*Primary Examiner*—Robert G. Sheridan
*Attorney, Agent, or Firm*—Armstrong, Nikaido, Marmelstein & Kubovcik

[57] ABSTRACT

The present invention is concerned with a novel furnace top charging apparatus, especially of the bell-less type, having a rotating distribution chute, wherein there is provided a portal truck serving as a stand on a floor under chuting bunkers, which normally supports collecting chutes, and moves them when requested. The collecting chutes have a mouth for mounting a vertical chute at an upper portion between pivots of two swingable sealing valves. These members enable efficient preservation, checking inspection or repair of the collecting chutes, the vertical chute and the rotating chute.

8 Claims, 11 Drawing Figures

FURNACE TOP CHARGING APPARATUS

BACKGROUND OF THE INVENTION

1. Field of the Invention

This invention relates to raw material charging apparatus at the top of the furnace, especially of the bell-less type having a rotating chute.

2. Description of the Prior Art

The raw material charging apparatus of the bell-less type are known which employ a chute in association with rotation and tilting for optional charging distribution in place of the large bell.

A conventional charging apparatus of this bell-less type will be discussed with reference to FIG. 1 of the attached drawings. The apparatus comprises bunkers 7, 8 which are alternately charged with raw materials by means of switching chutes provided with exhaust ports 65, 66 having raw material control gates 63, 64; a collecting chute 6a arranged under the exhaust ports 65, 66: a rotating drive chamber positioned under the collecting chute 6a via an elastic pipe 5; a vertical chute 4 which can be extracted upwardly is inserted in the rotating drive chamber 3; a rotating distribution chute 2, is provided under the vertical chute 4, which is movable up and down; and swingable sealing valves 67, 68 are furnished in the collecting chute 6a at parts thereof corresponding to the exhausting ports 65, 66 of the bunkers 7, 8 for avoiding leakage of gas during the charging operation. Thus, the raw materials are filled into either of the bunkers 7, 8, and passed through the collecting chute 6a, the vertical chute 4 and the rotary chute 2, and thrown into the furnace.

For fixedly securing the bunkers 7, 8 and the collecting chute 6a, upright beams 40, 41 stand from parts of the furnace 1 near the rotating driver 3, which terminate in height about the center of the collecting chute, and securing beams 42, 43 are placed on said terminations of the beams 40, 41 between which a box beam 44 is bridged thereover. In such ways, the bunkers 7, 8 are secured on the box beam 44, and the collecting chute 6a is supported through a horizontal supporting member 45.

In this type of the raw material charging apparatus, since the vertical chute is subject to extreme wear and the rotating drive chamber is easily subjected to abnormality owing to the functions and the charging operations, they are often taken out of the furnace for periodic inspection and also due to breakdowns. It is the general routine that the collecting chute 6a is taken away, and the vertical chute 4 and the rotating drive chamber 3 are removed. The collecting chute 6a can be easily removed, but because of the longitudinally and laterally positioned box beam 44, securing beams 42, 43 and upright beams 40, 41, only a limited narrow space remains. Further, the rotating drive chamber 3 which is very heavy (in general more than 30 tons) and the vertical chute 4 are removed by a winch, or the like, while care must be taken to prevent these components from colliding against the vertical beams 40, 41 or the securing beams 42, 43, and therefore, because of the many steps involved and a great deal of time and labor, expense and down time are required for repair.

SUMMARY OF THE INVENTION

It is an object of the invention to provide a furnace top charging apparatus of the bell-less type where the shortcomings of the prior art as discussed above have been overcome in order to make preservation and repairing easy and speedy, thereby shortening the interruption.

Another object of the invention is to easily transfer the collecting chute, the rotating driver and the vertical chute to the off-line or into the on-line.

Still another object of the invention is to easily carry out the repairing, exchanging or checking of the vertical chute without disassembling the collecting chute or the elastic pipe, and to continue the raw material charging, even through any one of the swingable sealing valves is broken down, with the easy repairing thereof.

In the new raw material charging apparatus at the top of the furnace of the bell-less type provided with a plurality of the bunkers, the collecting chute receiving the raw materials from the exhausting ports of the bunkers, the rotating drive chamber which is positioned under the collecting chute to upwardly extract the vertical chute, and the rotating chute which is positioned under the vertical chute and one end of which is pivoted on the rotating driver, the present invention provides a portal truck travelling on a floor under the bunkers and crossing over the rotating drive chamber, which truck supports the collecting chute for transferring it to the off-line as requested, and suspending the rotating drive chamber therefrom to move it to the free space.

Further, the invention provides a plurality of swingable sealing valves at divergent charging ports of the collecting chute corresponding to the exhausting port of the bunkers, said sealing valves having pivots at positions not hitting each other at full opening of the valves, and also provides a mouth for taking in and out the vertical chute at the upper part of the collecting chute corresponding to the center of said pivots.

Other objects or constitutions will be apparent from the following description and with reference to the attached drawing.

DETAILED DESCRIPTION OF THE INVENTION

Figure 1:
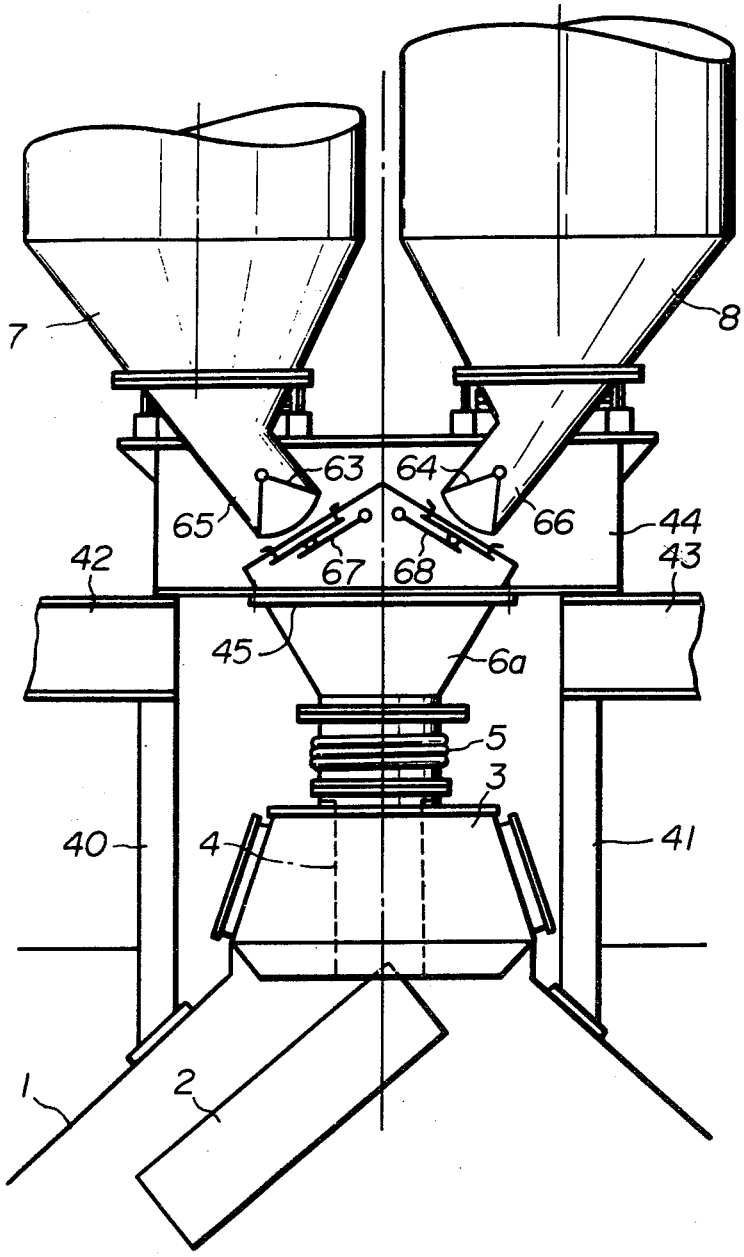
FIG. 1 PRIOR ART
FIG. 1 is a front view showing a conventional furnace top charging apparatus of the bell-less type.
Figure 2:
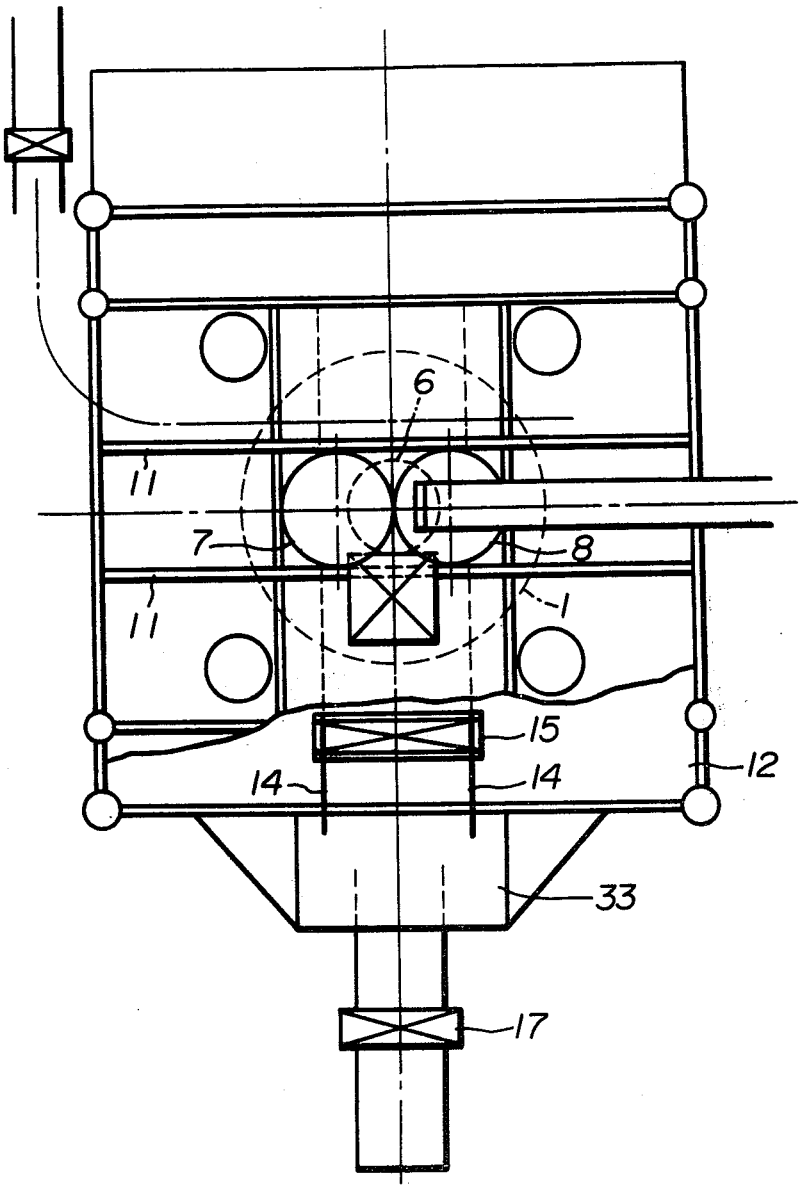
FIG. 2 is a plan view showing an embodiment of a charging apparatus at the top of a furnace according to the invention.
Figure 3:
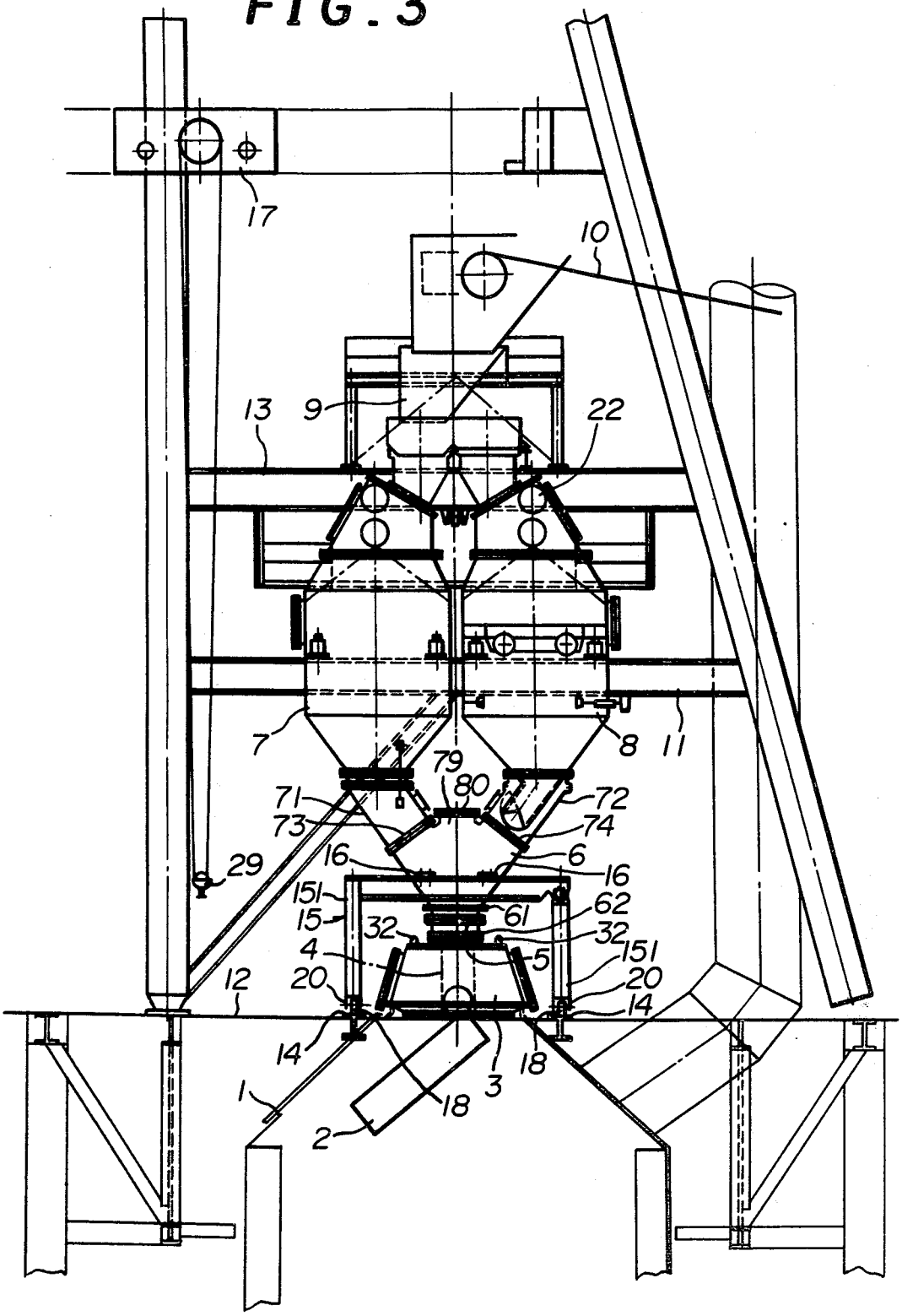
FIG. 3 is a front view, partially in section, of the charging apparatus of the invention.
Figure 4:
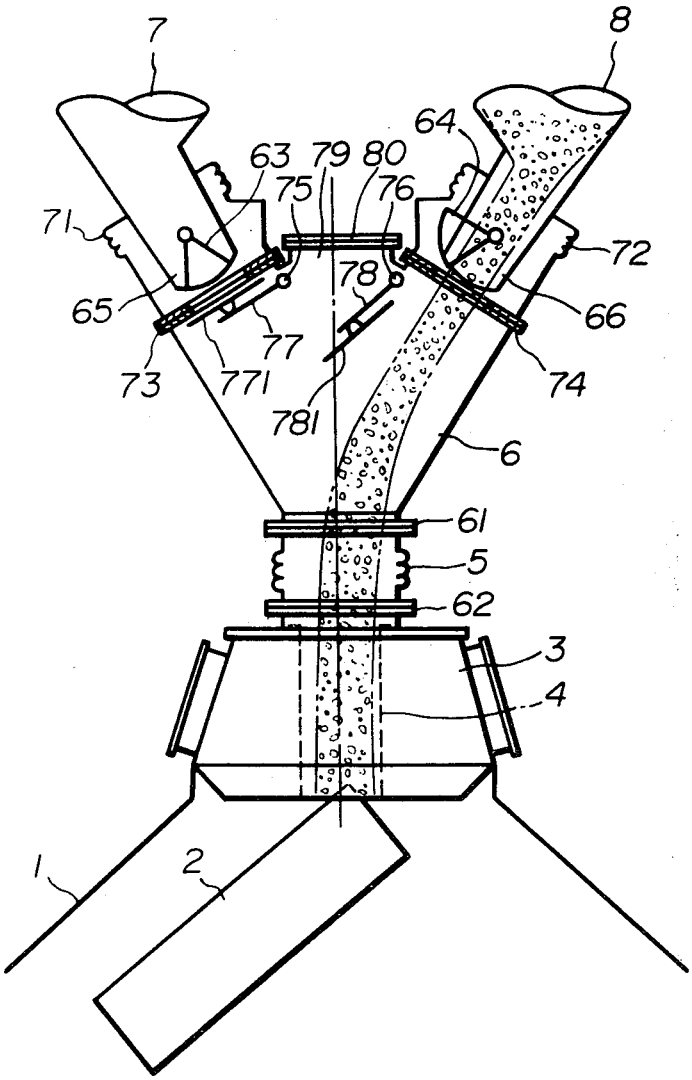
FIG. 4 is an enlarged view of the collecting chute.

The invention will be discussed with reference to the drawings. In FIGS. 2 and 3, 1 designates a furnace body, 2 shows a rotating distribution chute, 3 is a rotating drive chamber, 4 is a vertical chute, 5 is an elastic pipe, 6 is a collecting chute, 7, 8 show bunkers or storage hoppers, 9 is a switching chute, and 10 is a charging conveyor to the switching chute 9. The vertical chute 4 is engaged with an upper portion of the driver 3 via an upper flange. The collecting chute 3 is separately connected at its upper position to the bunkers 7, 8 by means of flanges 73, 74 via elastic couples 71, 72, and is separately connected at its lower portion to a flange 61.

Figure 5:
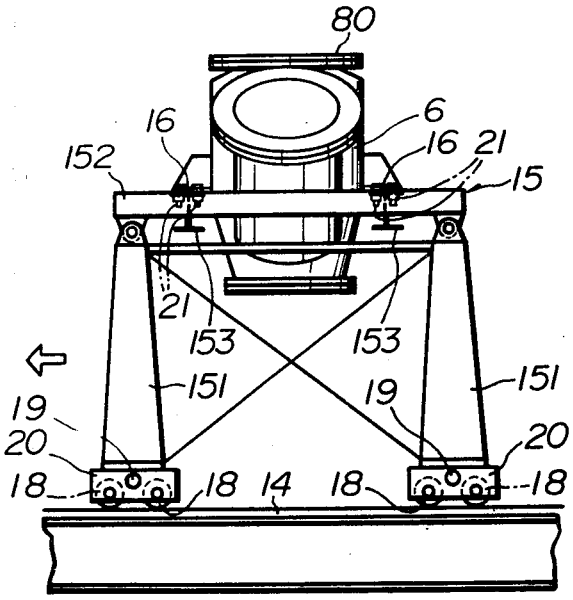
FIG. 5 is a side view of a portal truck in the present inventive apparatus.
Figure 6:
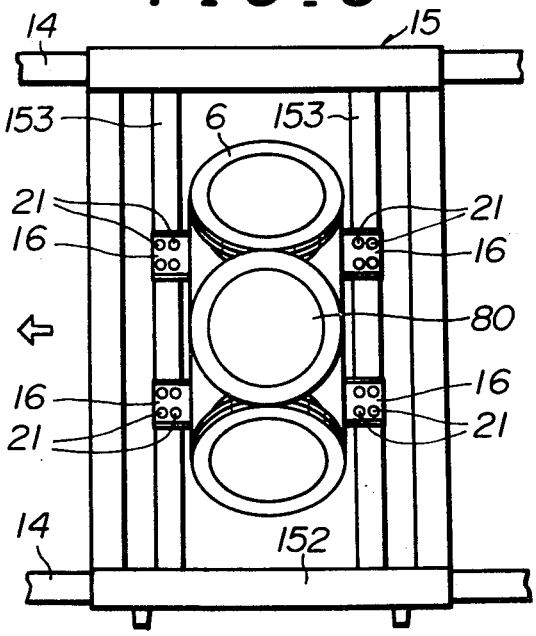
FIG. 6 is a plan view of the portal truck.
Figure 8:
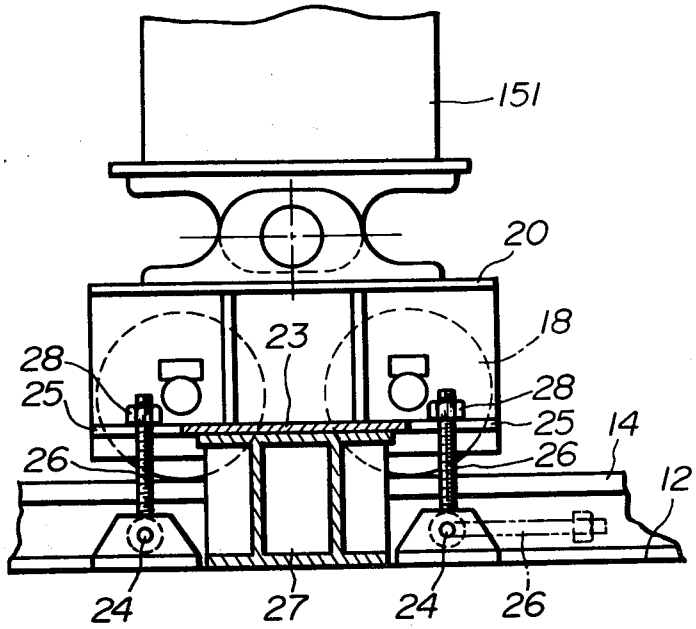
FIG. 8 is a side view of the portal truck securing mechanism.

A securing beam 11 is provided longitudinally at a position crossing centers of the bunkers 7, 8 for supporting the bunkers 7, 8, and guiding rails 14, 14 are laid on a deck 12 of the furnace top, extending from both sides of the driver 3 to an off-line 33 for a traveling portal truck 15. The portal truck 15 is provided, as a travelling mechanism, with wheels 18, 18 at a lower portion of feet 151 via wheel lockers 20. Motors 19 drive the wheels on the rails 14, 14, as shown in FIGS. 3 and 5. The portal truck 15 is provided as shown in FIGS. 5 and 6, with a plurality of parallel supporting beams 153 positioned between rectangular beams 152 on the feet 151, and the collecting chute 6 is positioned between the supporting beams 153, 153 of the truck 15. A plurality of supporting seats 16, 16 extending from both sides of the center of the collecting chute 6 are fixedly seated on the supporting beams 153, 153 by fixing means such as bolts to secure the collecting chute 6. A travelling crane 17 for repairing is provided above the securing beam 11 to suspend the collecting chute 6, the vertical chute 4 and the rotating drive chamber 3 from the condition as shown in FIG. 3. Either the upper beam 13 or the securing beam 11 is equipped with pulley blocks 22 at positions running through the centers of the collecting chute 6 and the vertical chute 4 and the rotating driver 3. Swingable sealing valves 77, 78 are provided at the divergent charging ports corresponding to the exhausting ports 65, 66 of the bunkers 7, 8, said sealing valves 77, 78 having pivots 75, 76 positioned such that they do not hit each other when they are fully open. A mouth 79, which is openable with a cover 80, is provided at an upper plate of the chute 6 for taking in and out of the vertical chute 4.

The portal truck 15 normally holds the collecting chute 6 during operation as shown in FIG. 3, and it is preferable that the portal truck 15 be stably secured without causing fluctuations, for which in the present embodiment, a fixing mechanism for the portal truck 15 is provided at the sides of the guiding rails 14, 14 corresponding to the lower portions of the feet of the portal truck 15 which stops at the predetermined position (the position shown in FIG. 3).

Figure 7:
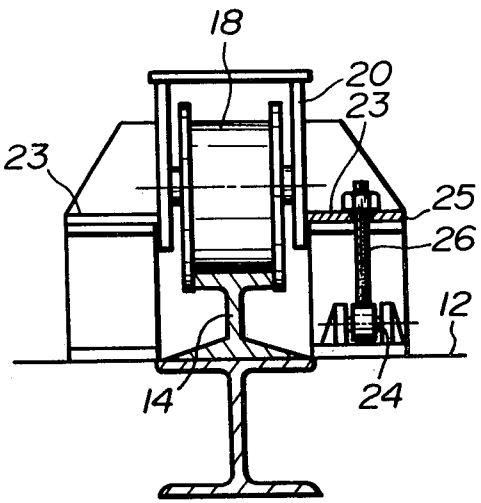
FIG. 7 is a front view of a securing mechanism of the portal truck in the inventive apparatus.

This fixing mechanism is, as shown in FIGS. 6 and 7, composed of fixed seating plates 23, 23 furnished at the wheel lockers 20 of the feet, a plurality of fixing bolts 26 which are so pivoted as to nod by a plurality of pivoting pins secured to the floor 12 spaced from each other and which are inserted into slits 25 of the seating plates 23 between the floor 12 and the seating plate 23, and is positioned between a plurality of the fixing bolts 26. In this regard, the fixing is carried out by inserting the saddle between the floor 12 and the seating plate 23 in a condition of positioning the portal truck 15, raising the fixing bolts 26, 26, and screwing nuts 28 onto the bolts 26, 26, thus the portal truck 15 is fixedly secured to the floor 12 via the wheel locker 20.

A reference numeral 29 designates a suspender furnished on a tow of the repairing crane 17, while 30 shows a wire for suspending the vertical chute 4 or the rotating drive chamber 3. A temporarily holding means 31, such as a short wire for temporarily holding the rotating drive chamber 3 on the supporting beam 153 is provided, and 32 is a hooking piece on the rotating drive chamber 3.

Figure 9:
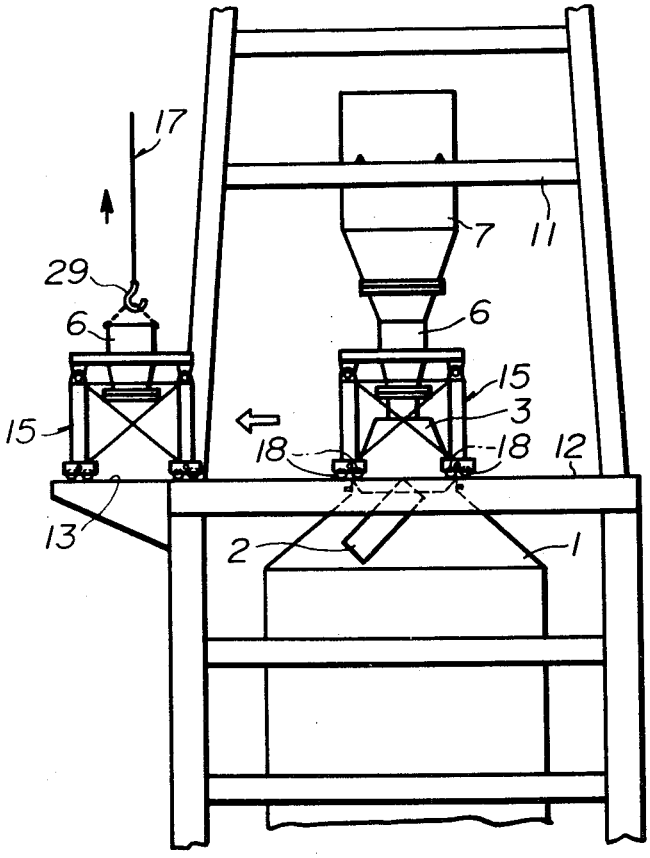
FIG. 9 is a side view showing the collecting chute removed according to the invention.
Figure 10:
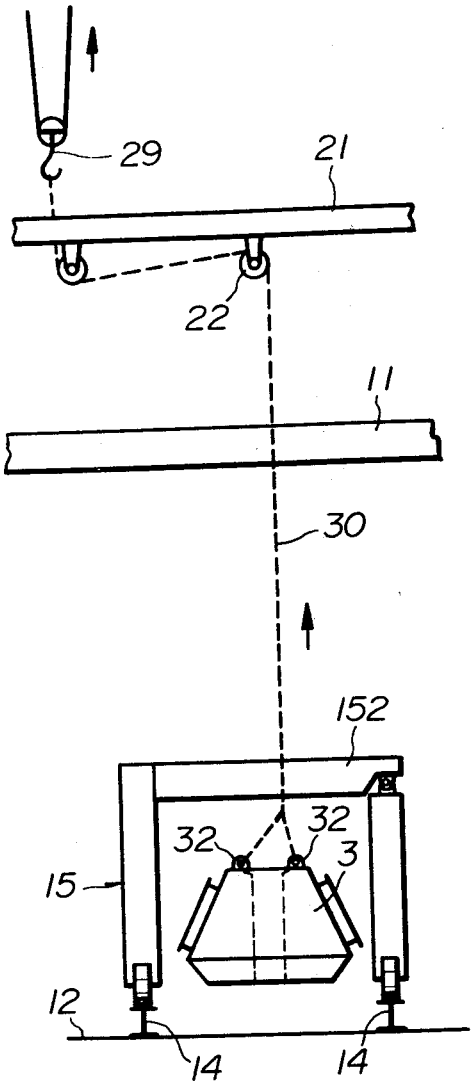
FIGS. 10 and 11 are front views showing in succession removal of a rotating drive chamber according to the invention.
Figure 11:
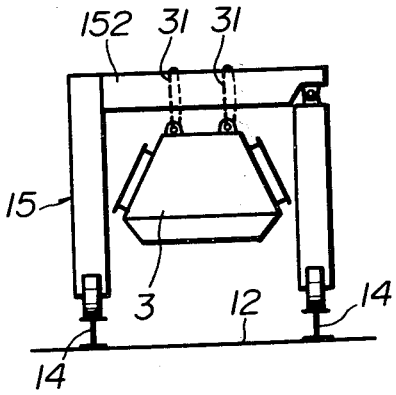

The present invention is constituted as above mentioned, and the collecting chute 6 is normally positioned as shown in FIG. 3 held by the portal truck 15 as it is connected to the bunkers 7, 8 and the elastic pipe 5 for smooth charging of the raw materials, but owing to the periodical repairings or sudden accidents the rotating driver 3 and the vertical chute 4 are taken out of the furnace by first separating the collecting chute 6 from the bunkers 7, 8 and the elastice pipe 5, and in such a manner the collecting chute 6 may be separated from the other mechanisms as it is held by the portal truck 15, and it is transferred to the off-line position 33 by moving the portal truck 15 are shown in FIG. 9, and there it is moved by the travelling crane 17.

When returning the portal truck 15, it is stopped under the bunkers 7, 8, crossing over the rotating drive chamber 3, and then the suspender 29 of the travelling crane 17 is connected to one end of the wire 30, the other end of which is connected to the vertical chute 4 via the pulley block 22. If the crane 17 winds the tow in such a condition, the vertical chute 4 may be easily taken out, and the vertical chute 4 is held on the portal truck 15 by the temporary fixing means 31 in this condition and the portal truck 15 is moved to transfer the vertical chute 4 to the free space.

The same may be applied to the rotating drive chamber 3. After the collecting chute 6 has been moved, the portal truck 15 is again returned to the position of the rotating drive chamber 3 and the lower ends of the wire 30 are hooked with the pieces on the rotating drive chamber, and the travelling crane 17 suspends the rotating drive chamber to hold it on to the portal truck 15 by means of the temporary fixing means 31. In this embodiment, the short wire is employed as the temporary fixing means 31 the ends of which are connected to the hooking pieces 32 of the rotating drive chamber 3 for suspending it, and if the portal truck 15 is moved, it is easily taken out of the furnace. A new rotating drive chamber or vertical chute may be easily exchanged in a reverse procedure of the above.

Furthermore, according to the present invention, the vertical chute 4 may be directly taken out or in without removing the collecting chute 6. The cover 80 of the collecting chute 6 is removed to release the gas sealing therein and one end of the wire is lowered into the collecting chute 6 from the mouth 79 to connect to the vertical chute 4 and the crane 17 winds up.

The swingable sealing valves 77, 78 are provided with the pivots 75, 76 at positions where the respective valves 771, 781 do not interface with each interfere because of the presence of the mouth 79, and therefore a problem is solved that the both sealing valves cannot be opened at the same time in the prior art, and thus, even if any one of the valves 77, 78 is out of order in an open state, the other is controlled to continue the charging operation. The mouth 79 brings out subsidiary effects on the preservation of the sealing valves 77, 78 and checking inspection.

We claim:

1. In a furnace top charging apparatus of the bell-less type comprising:

a plurality of bunkers;

exhaust ports positioned on a lower portion of said bunkers;

a collecting chute positioned below said exhaust ports for receiving materials discharged from said exhaust ports;

a vertical chute positioned below said collecting chute;

a rotating drive chamber operatively connected to a lower end of said vertical chute;

a rotary distribution chute positioned below said vertical chute, one end being pivoted to the rotary drive chamber, said rotary distribution chute, being adapted to throw raw material into a furnace after passing through said vertical chute; wherein the improvement comprises;

guide rails positioned on a floor under said bunkers on both sides of said rotating drive chamber said guide rails extending to an off-line position;

a portal truck mounted on said guide rails, said portal truck being adapted to support said collecting chute during charging operation and to transport said collecting chute and rotary drive chamber to said off-line position when desired.

2. In a furnace top charging apparatus of the type as claimed in claim 1 wherein the improvement further comprises, said portal truck including:

a plurality of feet;

a plurality of wheel means positioned on lower portions of said feet;

drive means for driving said wheels;

a plurality of parallelly positioned supporting beams supporting a plurality of rectangular beams, said rectangular beams operatively supporting said collecting chute via a plurality of fixing seats.

3. In a furnace top charging apparatus of the type as claimed in claim 1 wherein the improvement further comprises equipping said collecting chute with a plurality of swingable sealing valves having spaced pivots and a mouth is provided for receiving said vertical chute, said mouth being operable by a cover means, said cover means being positioned at a location corresponding to the centers of said spaced pivots.

4. In a furnace top charging apparatus of the type as claimed in claim 1 wherein the improvement further comprises a travelling repair crane positioned above a securing beam supporting said bunkers, said travelling repair crane being adapted to suspend said collecting chute, vertical chute and rotating drive chamber.

5. In a furnace top charging apparatus of the type as claimed in claim 1 wherein the improvement further comprises pulley blocks provided on said securing beam supporting said bunkers, said pulley blocks being adapted to run verticaly through the centers of said collecting chute and vertical chute, for suspending said vertical chute and rotating drive chamber.

6. In a furnace top charging apparatus of the type as claimed in claim 1 wherein the improvement further comprises providing said rotating drive chamber with a plurality of hooking pieces on its upper face for operatively temporarily mounting said rotating drive chamber on either a suspending wire or a supporting beam.

7. In a furnace top charging apparatus of the type as claimed in claim 1 wherein the improvement further comprises a securing mechanism for said portal truck, said securing mechanism being provided at the sides of said guide rails at positions corresponding to the feet of said portal truck.

8. In a furnace top charging apparatus of the type as claimed in claim 7 wherein the improvement further comprises said wheel means including seat lockers and seating plates; and a plurality of pivotally mounted fixing bolts are provided at the sides of said guide rails at positions corresponding to said seat lockers and seating plates, said seating plates being provided with slits adpated to receive said pivoted fixing bolts, and a saddle being sandwiched between said fixing bolts, floor and seating plate.

* * * * *